US007847688B2

(12) United States Patent
Bernard et al.

(10) Patent No.: US 7,847,688 B2
(45) Date of Patent: Dec. 7, 2010

(54) METHOD AND APPARATUS OF PROTECTING A PHYSICAL ACCESS

(75) Inventors: Emmanuel Bernard, Paris (FR); Jean-Christophe Fondeur, Paris (FR); Laurent Lambert, Paris (FR)

(73) Assignee: Morpho, Paris (FR)

( * ) Notice: Subject to any disclaimer, the term of this patent is extended or adjusted under 35 U.S.C. 154(b) by 373 days.

(21) Appl. No.: 12/086,526

(22) PCT Filed: Dec. 6, 2006

(86) PCT No.: PCT/EP2006/011700

§ 371 (c)(1),
(2), (4) Date: Jun. 13, 2008

(87) PCT Pub. No.: WO2007/068385

PCT Pub. Date: Jun. 21, 2007

(65) Prior Publication Data

US 2009/0002144 A1 Jan. 1, 2009

(30) Foreign Application Priority Data

Dec. 16, 2005 (FR) ..... 05 12857

(51) Int. Cl.
*G08B 13/00* (2006.01)

(52) U.S. Cl. ..... 340/541; 340/522; 340/573.7

(58) Field of Classification Search ..... 340/517, 340/518, 540, 541, 522, 550, 573.1, 573.7; 455/456.3; 705/44; 706/2; 713/185, 189
See application file for complete search history.

(56) References Cited

U.S. PATENT DOCUMENTS

| | | | | |
|---|---|---|---|---|
| 6,105,010 | A * | 8/2000 | Musgrave | 705/44 |
| 7,278,025 | B2 * | 10/2007 | Saito et al. | 713/185 |
| 7,318,050 | B1 * | 1/2008 | Musgrave | 705/44 |
| 7,376,431 | B2 * | 5/2008 | Niedermeyer | 455/456.3 |
| 7,684,809 | B2 * | 3/2010 | Niedermeyer | 455/456.3 |
| 2002/0097145 | A1 | 7/2002 | Tumey et al. | |
| 2006/0136746 | A1 * | 6/2006 | Al-Khateeb | 713/189 |
| 2006/0190419 | A1 * | 8/2006 | Bunn et al. | 706/2 |
| 2007/0025534 | A1 * | 2/2007 | Yezhuvath et al. | 379/114.14 |

FOREIGN PATENT DOCUMENTS

| | | | |
|---|---|---|---|
| EP | 0706062 | A1 | 4/1996 |
| FR | 2713805 | | 6/1995 |
| FR | 2871602 | | 12/2005 |
| WO | WO 03/088157 | A1 | 10/2003 |

* cited by examiner

*Primary Examiner*—Van T. Trieu
(74) *Attorney, Agent, or Firm*—Gerald E. Helget; Nelson R. Capes; Briggs and Morgan, P.A.

(57) ABSTRACT

A method of improving the rate of detection of attempts at fraud when a person passes through a controlled space based on the use of different sets of parameters issuing from at least two different sensor systems, some sets of parameters being based on correlations of measurements issuing from various sensor systems. Learning is carried out so as to characterize various types of fraud to permit identification of attempts at fraud by correlation between measurements obtained and characterizations of each type of fraud for each set of parameters.

8 Claims, 3 Drawing Sheets

METHOD AND APPARATUS OF PROTECTING A PHYSICAL ACCESS

CROSS REFERENCE TO RELATED APPLICATIONS

The present application is a national stage filing of and claims priority of International Patent Application No. PCT/EP2006/011700, filed Dec. 6, 2006 and French Application No. 05/12857 filed Dec. 16, 2005, the content of which is hereby incorporated by reference in its entirety.

BACKGROUND OF THE INVENTION

The invention is situated in the field of the control of physical access to entrances to a sensitive area and more particularly checking the uniqueness of a person passing through a controlled passage. This field contains two types of problem, a first consisting of authenticating a person presenting himself, the second consisting of ensuring that only the authenticated person passes through the controlled passage so as to guard against fraud or an unauthorised person profiting from the passage of an authorised person in order to slip through ("tailgating" in English).

A method of detecting uniqueness in a lobby is known from the document EP 0 706 062. This method couples a ticket reader for validating a transport pass and ultrasonic detection. Only one type of sensor is used.

A method of protecting an access based on the authentication of persons by a single sensor system is known from the document US 2002/097145 A1. It is not sought to ensure uniqueness of the passage.

A method of protecting access by image analysis is known from the document WO 03/088157 A. A detection of the objects is carried out, these objects are classified, and characteristics are extracted from them in order to determine attempts at fraud.

An access control system having three different zones is known from the document FR 2 713 805. In a first so-called toll zone, the users make the payment. In a second zone, the persons are counted. In a third zone, referred to as the passing zone, a barrier may close where the number of persons counted is higher than the payment number. The aim here is to count the persons rather than to identify fraud types of fraud.

It is known from FR 2 871 602 A how to use a pressure mat on the ground for determining whether one person or more are situated on the mat and controlling the opening of a door according to the result of this test.

Systems for counting persons using an entrance by video image processing are known through the document EP 1 100 050 A1. In this document, only one type of sensor is used. It is also known through the document US 2002/0067259 A1 how to use several types of sensor to determine the presence of a person and his uniqueness. In this document, it is described how to correlate the data from several sensors, a beam cutoff configuration and a heat detector, in order to detect a non-human object so as to discriminate a person with luggage from an intrusion. As for the document US 2004/0188185, this describes correlating the information from a heat image and an optical image in order to count the number of persons present in a space. In the document EP 1 308 905 A1 a description is given of the use of a pressure-sensitive mat for detecting the presence of persons and their direction of movement, and effecting a counting from the data from the mat and their change over time.

These methods are however not sufficient to detect with reliability attempts at fraud by a determined person.

SUMMARY OF THE INVENTION

The invention aims to improve the detection rate for attempts at fraud when a person is passing through a controlled space. It is based on the use of different sets of parameters issuing from at least two different sensor systems, some of these sets of parameters being based on correlations of measurements issuing from these various sensor systems. Learning is carried out so as to characterise different types of fraud in order then to allow the identification of an attempt at fraud by correlation between the measurements obtained and the characterisations of each type of fraud for each set of parameters.

The invention concerns a method of protecting physical access having a plurality of sensor systems (1.4, 1.5, 1.6), the method being aimed at distinguishing valid access from a fraudulent attempt at access, comprising the following steps:

in a preliminary phase:

determining at least one set of parameters issuing from sensor systems including at least one set of parameters issuing from at least two different systems (6.1);

determining by learning, for each set of parameters and for each type of fraud envisaged, a class of values of the parameters in the set corresponding to this type of fraud for this set of parameters (6.2);

during access:

determining sets of values formed by the values taken by each parameter of each set of parameters for this access (6.3);

determining a probability of fraud associated with each type of fraud for each set of parameters, according to the set of values determined during this access and the class corresponding to the type of fraud for this set of parameters (6.4);

determining a global probability of fraud associated with the access according to the probabilities of fraud obtained for each set of parameters and for each type of fraud (6.5).

According to a particular embodiment of the invention the probability of fraud associated with each type of fraud for each set of parameters is estimated by calculating a distance between the set of values determined during this access and the class corresponding to the type of fraud for this set of parameters.

According to a particular embodiment of the invention, this distance is an algebraic distance between the set of values determined and the barycentre of the class.

According to a particular embodiment of the invention the probability of fraud associated with each type of fraud for each set of parameters is estimated by a neuromimetic network and the step of determination by learning of the classes comprises a step of training this neuromimetic network.

According to a particular embodiment of the invention the sensor systems comprise a system of cameras (1.5, 1.6) supplying profile images (1.8, 1.9, FIG. 3).

According to a particular embodiment of the invention the sensor systems comprise a pressure mat system on the ground (1.4) supplying pressure images (1.7, FIG. 4).

The invention also comprises a device for protecting a physical access comprising:

a control space;

a plurality of sensor systems in this control space (1.4, 1.5, 1.6)

means of analysing the information issuing from the sensor system (1.9);

and knowing that there is determined at least one set of parameters issuing from the sensor systems, including at least one set of parameters issuing from at least two different sensor systems, being determined by learning, for each set of parameters and for each type of fraud envisaged, a space class of values of the parameters of the set corresponding to this type of fraud for this set of parameters, the analysis means comprising:

means of determining sets of values formed from the values taken by each parameter of each set of parameters for this access;

means of determining a probability of fraud associated with each type of fraud and for each set of parameters, according to the set of values determined during this access and the class corresponding to the type of fraud for this set of parameters;

means of determining a global probability of fraud associated with the access according to the probabilities of fraud obtained for each set of parameters and for each type of fraud.

BRIEF DESCRIPTION OF THE DRAWINGS

The characteristics of the invention mentioned above, as well as others, will emerge more clearly from a reading of the following description of an example embodiment, the said description being given in relation to the accompanying drawings, among which.

DETAILED DESCRIPTION OF ILLUSTRATIVE EMBODIMENTS

In the context of the control and protection of physical accesses, it is often crucial to verify that a person is indeed the only one to have passed through a door, a corridor, a security lobby, etc. Detection of uniqueness can then be spoken of. The turnstile in the metro or the secure double door in an airport are examples of implementation of the detection of uniqueness. The measurement means used can be of all types: pressure or temperature sensor, optical means (camera, laser beams etc). Likewise the analysis of the measurements can be consolidated to a greater or lesser extent (combined or independent use of the data), interpreted (taking dynamic or static factors into account), etc.

The system described here is based on a system of detecting uniqueness using a pressure mat on the ground. The advantage of a system of this type is observing the contacts on the ground and their change over time in order to be able to deduce the number of persons present according to the traces present on the ground and their changes. Nevertheless, there exist very simple means of defrauding such a system by reducing the contacts on the ground. For example, two persons may pass simultaneously if they are sufficiently close to each other.

The object of the invention is to consolidate the existing detection of uniqueness by using a combination of pressure sensors on the ground and cameras and/or profile detection, and to treat attempts at fraud with an algorithm for the merging of data and behavioural analysis of the objects detected. Thus the algorithm makes it possible to classify the passage according to the type of possible attacks by comparing the measurements made and the different classes associated with the types of fraud envisaged, and the decision on fraud or not is then taken according to the class.

Figure 1:
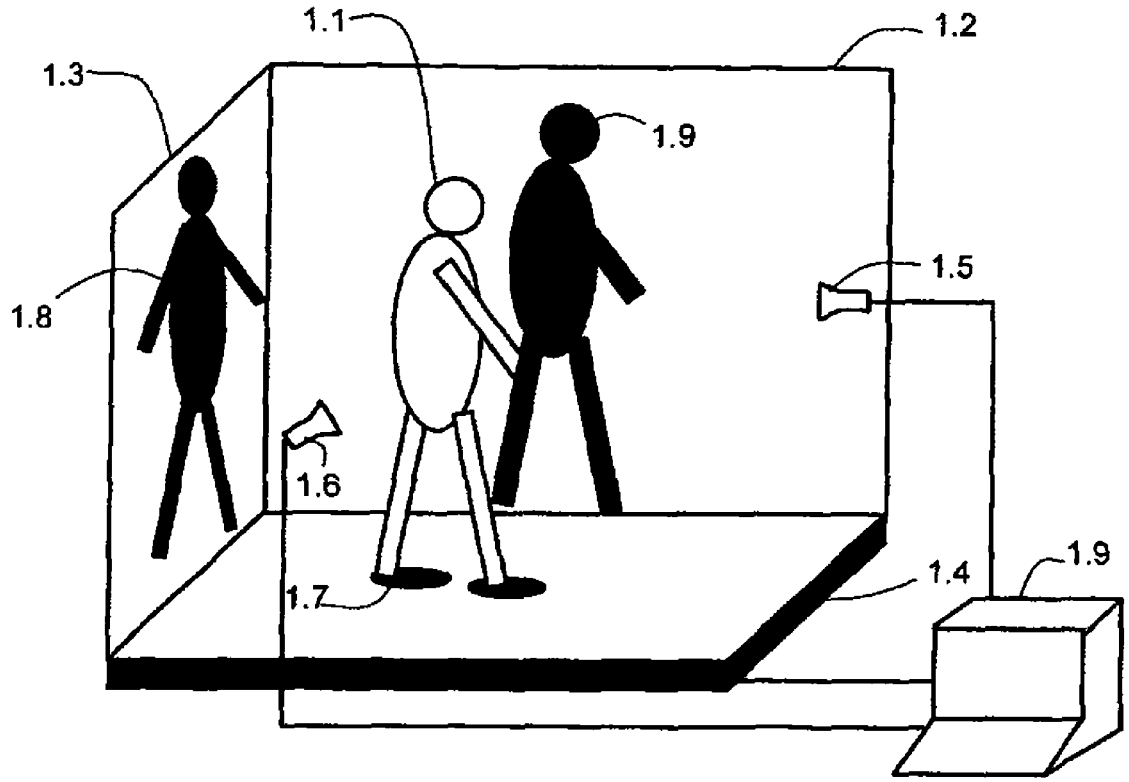
FIG. 1 depicts an overall diagram of an embodiment of the invention.
Figure 3:
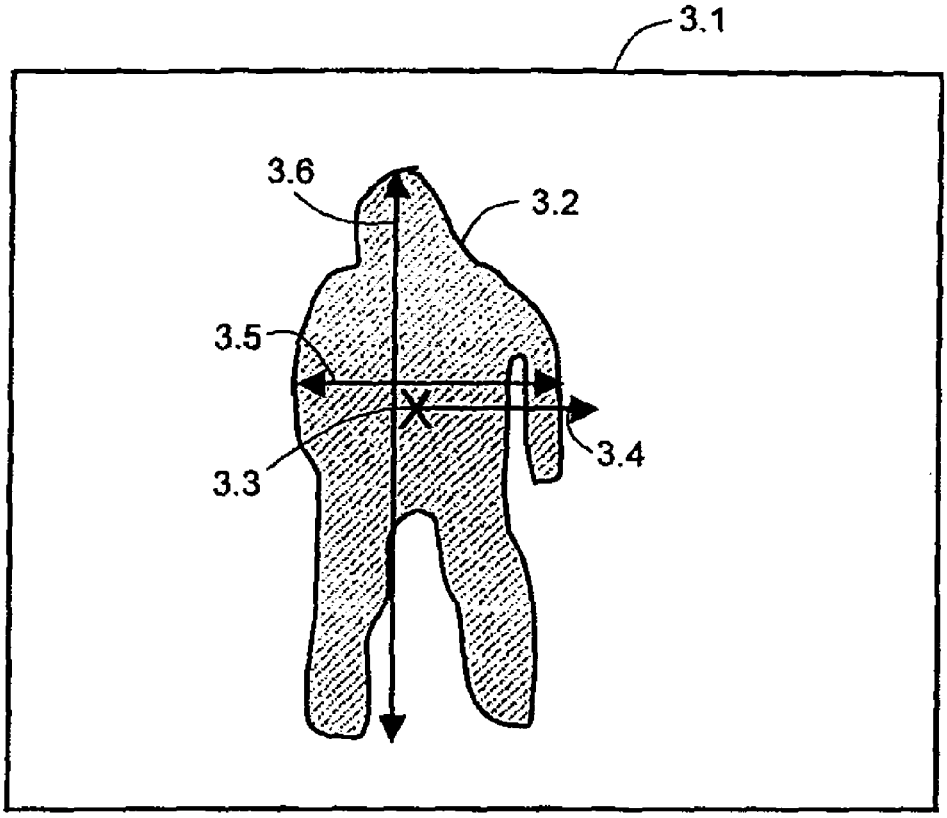
FIG. 3 depicts an example of a profile image obtained by a camera.
Figure 4:
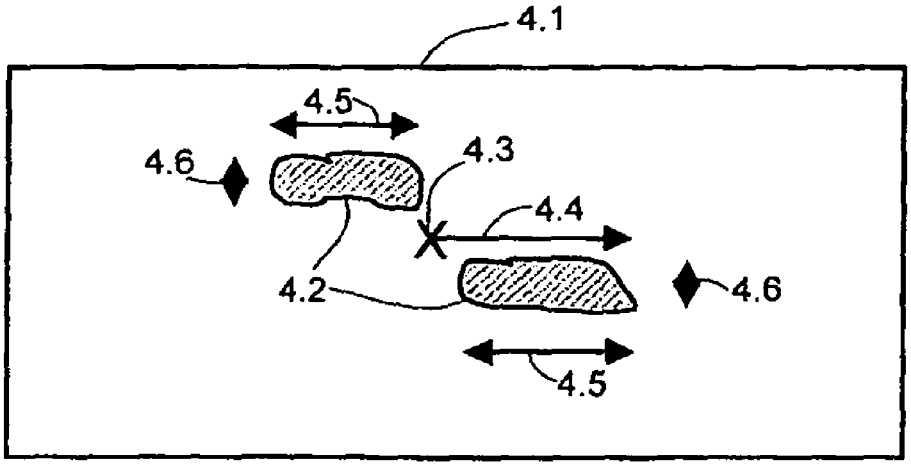
FIG. 4 depicts an example of a pressure image obtained by a pressure mat.
Figure 5:
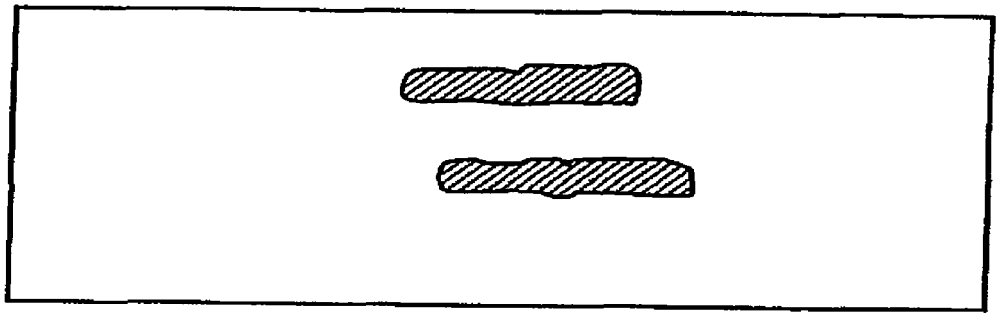
FIG. 5 depicts an example of a pressure image corresponding to a passage followed, back to back by "juxtaposing the feet".

In the example embodiment described, the invention is implemented within a lobby controlling access. This lobby is shown schematically in FIG. 1. A person 1.1 passes through the lobby from left to right. The lobby is equipped with a certain number of sensor systems. Sensor system means a system allowing the acquisition of information and based on a plurality of sensors of the same type. The lobby is equipped at floor level with a first sensor system consisting of a pressure-sensitive mat 1.4. This mat supplies a two-dimensional pressure image 1.7 supplying at each of its points the level of pressure exerted. One example of these pressure images is shown in FIG. 4. These images make it possible to determine the contacts between a person or an object present in the lobby and the ground and to calculate its weight and to have an idea on the distribution of this weight in the plane. Moreover, the pressure belt is capable of acquiring pressure images periodically, which also makes it possible to study the dynamic behaviour of these objects and to deduce therefrom, for example, a mean movement speed, a direction and the relative movements between objects. The lobby is also provided with a second sensor system consisting of video cameras 1.5 and 1.6. These cameras are two in number in the example embodiment but their number may be higher or lower according to the quantity of information that it is wished to obtain. It is possible in particular to add a camera on top. These cameras supply profile images 1.2, 1.3 for determining profiles 1.8, 1.9 associated with the persons or objects present in the lobby. The floor and walls of the lobby can be in saturated colours in order to limit the problems caused by shadows cast by the persons or objects present in the lobby. An example of a profile image is shown in FIG. 3.

This device can be supplemented by other sensor systems such as infrared barriers, diodes, lasers or the like for detecting the arrival of a person or an object in the lobby, measuring the heat emitted by a person as well as any other useful parameter. The lobby is also generally provided with authentication means, not shown, such as a badge reader or biometric identification means such as a reader for the iris of the eye or fingerprints.

The lobby is typically connected to means of acquiring the data produced by the sensor systems, means of analysing these data, taking a decision and controlling. These means can consist of computer 1.9 that is provided with a hard disk for storing the images received, both pressure and profiles, as well as programs necessary for processing these images and extracting therefrom the parameters that are used for determining whether passage is validated or not. In the case of a validated passage, this computer may for example enable the opening of a door situated at the end of the lobby. In the contrary case, the door remains closed and an alarm may be emitted in the direction of a surveillance station or the like.

A person wishing to defraud and therefore to enter without authorisation generally attempts to profit from the passage of an authorised person in order to slip through the door via the lobby. This attempt may be made unknown to the authorised person, who will for example assume that the person following him is also authorised. This attempt may also be made with the complicity of the authorised person or by coercion. It is therefore a case for the fraudster of attempting to deceive the sensor systems by attempting to conceal his passage. To do this, he may attempt to stick to the first person, for example back to back, in order to deceive the cameras, and to juxtapose his feet alongside those of the first person so that the system distinguishes only two "large" footprints, see for example the pressure image in FIG. 6. This type of fraud will be referred to as "juxtapositions fraud". The fraudster may also attempt to pass crouching down, or by remaining exactly alongside the authorised person. Certain particular cases may also pose problems of recognition of a child alongside an adult or even a baby in the arms of its mother. These attempts at fraud represent only examples of possible types of fraud. The challenge of the system is therefore to succeed in discriminating valid passages of a single person, whatever the size, body make-up, stance or luggage of this person in an attempt at fraud such as the ones that have just been described.

According to these types of fraud that it is necessary to detect, it is necessary to choose a certain number of parameters issuing from the sensor systems. These parameters may be data directly issuing from the sensors or parameters calculated from the information supplied.

For the camera system, it is possible to obtain, from the images taken, so-called profile images. These images are obtained by discrimination of the subject with respect to the background. The digital image processing techniques necessary are known. Once these profile images are obtained, it is possible to extract therefrom parameters as illustrated by FIG. 3. The location of the centre of gravity 3.3 of the object 3.2, its height 3.6 and its width 3.5 are easily obtained. Through an analysis of the images over time, it is also possible to extract the mean speed 3.4 of the centre of gravity. It is also possible to apply an algorithm making it possible to count heads, in fact an algorithm that will count the protrusions on the profile 5.1 in its upper part. Through crossing of the profiles issuing from several cameras, it is also possible to calculate the volume of the object, as well as the distribution of this volume according to the height of the object. It is possible for example to chose to divide the height into three equal parts and to determine the percentage of the volume situated in the bottom part, the middle part and the top part of the object. These parameters represent only examples of parameters that can be envisaged issuing from the camera system.

In a similar manner, parameters are extracted from the sensor system formed by the pressure mats. The pressure images, such as those illustrated in FIG. 4, here also make it possible to obtain, for each object 4.2, its height 4.6, its width 4.5 and the global centre of gravity of the detected objects 4.3. A study of the changes over time in the objects makes it possible to calculate the mean speed of movement 4.4 of this centre of gravity as well as the mean over time of the previous values. It is also possible to calculate global height and width. Integration of the pressure values affords an estimation of the total weight of the objects present in the lobby.

The same can be done with all the sensor systems that it is chosen to use. Each of them is able to supply parameters that can be useful for the detection of the various types of fraud possible in the lobby.

Apart from these parameters issuing from each system of sensors, using at least two sensor systems makes possible the calculation of supplementary parameters issuing from the correlation of information supplied by each of the sensor systems. It is for example possible to establish a volume/weight ratio of the objects present in the lobby, or the difference in speed of movement between the objects detected by the cameras and the objects detected by the pressure belt. It is also possible to compare the positions and number of contacts on the ground with the objects detected by the cameras.

Figure 6:
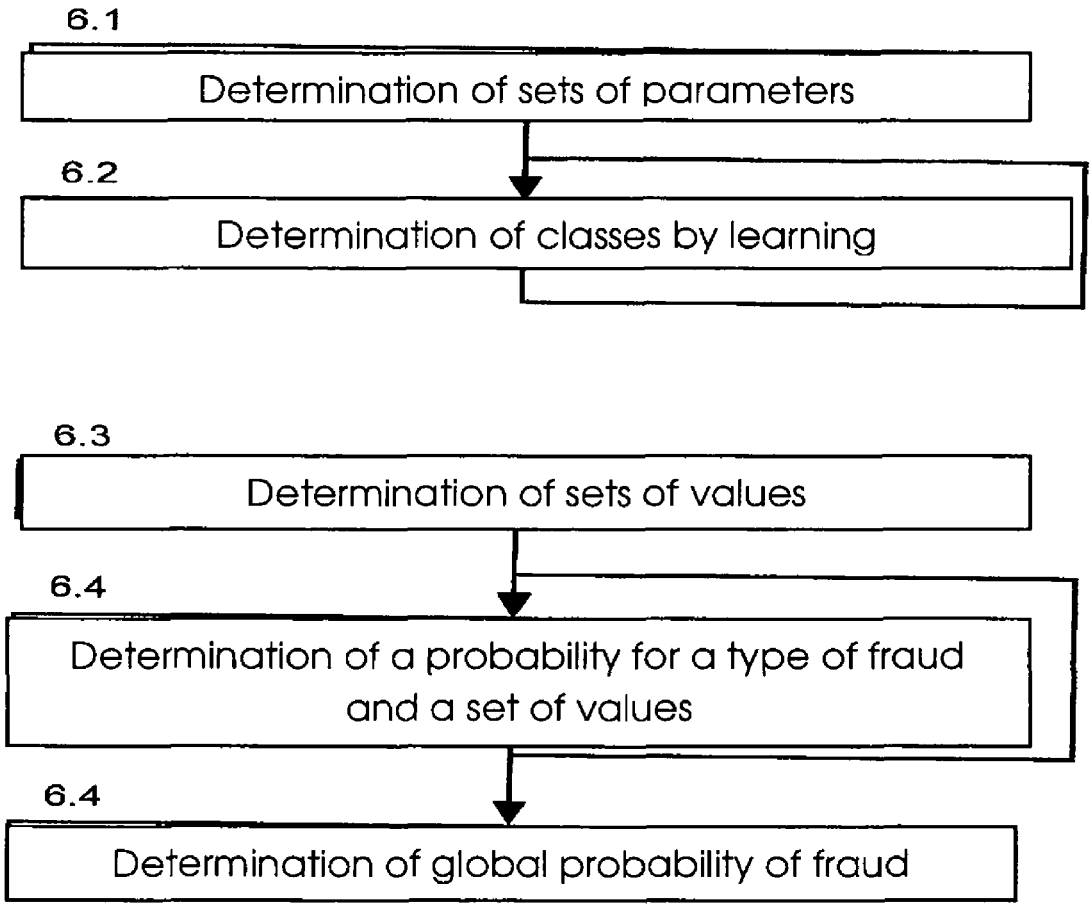
FIG. 6 depicts a flow diagram of the method.

A choice is made among all these possible parameters. In this way a certain number of sets of parameters are defined as illustrated in FIG. 6, step 6.1. The parameters chosen issuing from a sensor system are matched to a set of parameters. The parameters issuing from the correlation between two sensor systems will also supply a set of parameters. In this way one set of parameters per sensor system and one set of parameters by correlation made between two sensor systems are obtained. For each access through the lobby, the system is therefore capable of calculating a set of sets of values for each set of parameters corresponding to this access.

In order to be able to determine the validity of an access, that is to say to respond to the question whether this passage corresponds to the passage of a single person or not, it is therefore necessary to determine whether a collection of sets of parameters calculated during this access corresponds to the passage of a single person or an attempt at fraud.

Figure 2:
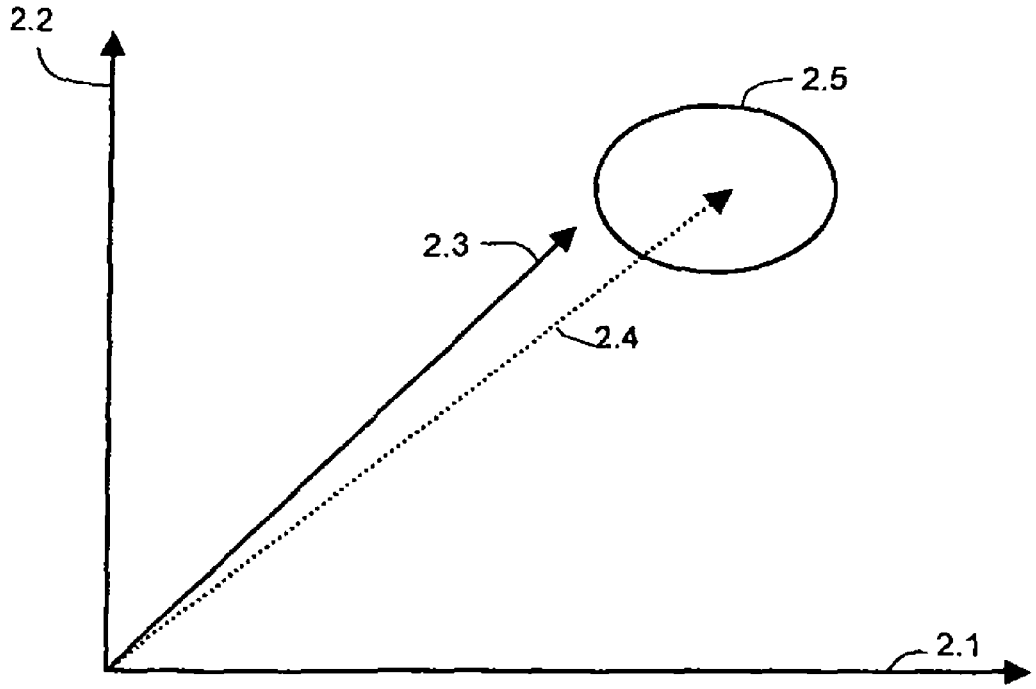
FIG. 2 depicts graphically a characterisation class for a type of fraud in the space of a set of parameters according to an embodiment of the invention.

To do this, it is possible to proceed with a learning phase. The values of the various sets of parameters defined above will be recorded. Each set of parameters can be seen as a multidimensional space where each dimension corresponds to a parameter. During a given passage, the values calculated for each parameter define a vector in this space representing the set of values. This is illustrated in FIG. 2. In this figure a three-dimensional space is shown corresponding to a set of three parameters. Each of the dimensions 2.1, 2.2, 2.3 therefore corresponds to a parameter of the set. The vector 2.5 corresponds to the values measured or calculated during a given passage. The successive measurements of various passages give a collection of vectors defining a class of values corresponding to these passages. Such a class 2.5 is shown in FIG. 2. For each set of parameters a class is thus defined corresponding to the measurements made during a series of passages. If such series of measurements are made for valid passages, then for passages corresponding to attempts at fraud there are established for each set of parameters classes corresponding to a valid passage and classes corresponding to the types of fraud envisaged. In this way there is obtained, as illustrated in FIG. 6 step 6.2, and for each set of parameters, a class corresponding to the various attempts at fraud.

When it is sought to classify a passage or access the first step is therefore to require the information from each sensor system. This information is then used to calculate the parameters corresponding to each set of parameters. The sets of values corresponding to each set of parameters, as illustrated in FIG. 6, step 6.3, are therefore obtained. It is therefore possible to calculate a distance measurement between the values of parameters measured and/or calculated of a set of parameters and the various classes corresponding to the various types of passage. This distance measurement may be a simple algebraic distance between the vector measured and the barycentre of the vectors of the class or any other distance measurement in space. From this distance there is derived a possibility that the passage belongs to the class in question, as illustrated in FIG. 6, step 6.4. Each set of parameters is thus classified and a probability is associated with this classification. The passage is classified by consolidation of the classifications obtained for each set of parameters, as illustrated in FIG. 6, step 6.5.

Alternatively the steps of classifying a set of parameters can be performed by a formal neural network, otherwise referred to as a neuromimetic network. These networks function on the model of an interconnection of formal neurones, each of its formal neurones effecting a weighted sum of its inputs and applying to this sum a non-linear output function, which may be a simple threshold or a more sophisticated function such as the sigmoid function. The knowledge or information stored in the network corresponds to the synaptic weight of each neurone, these weights being calculated by learning. This learning is done by means of a "training" algorithm, which consists of modifying the synaptic weights according to a set of data presented at the input of the network. The aim of this training is to permit the neural network to "learn" from examples. If the training is carried out correctly, the network is capable of providing responses as an output very close to the original values of the set of training data. However, the entire interest of neural networks lies in their capacity to generalise from the test set. Such a neural network trained on the passages constituting the classes during a learning phase is therefore in a position to carry out reliably a classification of the passages and to give for each passage a probability associated with each set of parameters and each passage or access.

The pertinence of the choice of parameters constituting the set of parameters for each sensor system, the use of sets of supplementary parameters involving in their calculations several sensor systems as well as the characterisation in space of each set of parameters of the types of fraud by learning are so many factors each contributing to the robustness and reliability of the classification.

A person skilled in the art will understand that the invention, although describing the use of a pressure mat and camera, may include in the same way various sensor systems such as infrared or laser barriers, infrared cameras, diode systems or any other means of obtaining information on the objects or bodies present in a control space. Likewise, the invention described aims to discriminate the uniqueness of presence of a person, but it could just as easily apply to other criteria, such as the uniqueness of a vehicle or the like.

The invention claimed is:

1. A method of protecting physical access having a plurality of sensor systems (1.4, 1.5, 1.6), the method being aimed at discriminating valid access from a fraudulent attempt at access, comprising the following steps:

in a preliminary phase:

determining at least one set of parameters issuing from sensor systems including at least one set of parameters issuing from at least two different systems (6.1);

determining by learning, for each set of parameters and for each type of fraud envisaged, a class of values of the parameters in the set corresponding to this type of fraud for this set of parameters (6.2);

during access:

determining sets of values formed by the values taken by each parameter of each set of parameters for this access (6.3);

determining a probability of fraud associated with each type of fraud for each set of parameters, according to the set of values determined during this access and the class corresponding to the type of fraud for this set of parameters (6.4);

determining a global probability of fraud associated with the access according to the probabilities of fraud obtained for each set of parameters and for each type of fraud (6.5).

2. The method of claim 1, where the probability of fraud associated with each type of fraud for each set of parameters is estimated by calculating a distance between the set of values determined during the access and the class corresponding to the type of fraud for each set of parameters.

3. The method of claim 2, where the distance is an algebraic distance between the set of values determined and the barycentre of the class.

4. The method of claim 1, where the probability of fraud associated with each type of fraud for each set of parameters is estimated by a neuromimetic network and where the step of determining the classes by learning comprises a step of training this neuromimetic network.

5. The method of claim 1, where the sensor systems comprise a system of cameras (1.5, 1.6) supplying profile images (1.8, 1.9, FIG. 3).

6. The method of claim 1, where the sensor systems comprise a pressure mat system on the ground (1.4) supplying pressure images (1.7, FIG. 4).

7. A device for protecting physical access to a sensitive area using a control space comprising:

a plurality of sensor systems for issuing information about the control space (1.4, 1.5, 1.6), communicating with a computer that analyzes the information issuing from the sensor system (1.9), the information being determined comprising:

at least one set of parameters issuing from the sensor systems including at least a second set of parameters issuing from at least two different sensor systems, being determined by learning, for each set of parameters and for each type of fraud envisaged, a space class of values of the parameters of the set corresponding to each type of fraud for each set of parameters, and;

the computer comprising:

a program determining sets of values formed from the values taken by each parameter of each set of parameters relating to physical access in the control space;

a second program determining a probability of fraud associated with each type of fraud and for each set of parameters, according to the set of values determined during physical access in the control space and the class corresponding to the type of fraud for this set of parameters;

a third programs determining a global probability of fraud associated with the physical access in the control space according to the probabilities of fraud obtained for each set of parameters and for each type of fraud, and protecting physical access to the sensitive area based on the global probablity of fraud.

8. A device for protecting physical access to a sensitive area using a control space comprising:

a plurality of sensor systems for issuing information about the control space (1.4, 1.5, 1.6), communicating with a neuromimetic network that analyzes the information issuing from the sensor system (1.9), the information being determined comprising:

at least one set of parameters issuing from the sensor systems including at least a second set of parameters issuing from at least two different sensor systems, being determined by learning, for each set of parameters and for each type of fraud envisaged, a space class of values of the parameters of the set corresponding to each type of fraud for each set of parameters, and;

the neuromimetic network comprising a plurality of interconnected formal neurons for:

determining sets of values formed from the values taken by each parameter of each set of parameters relating to physical access in the control space;

determining a probability of fraud associated with each type of fraud and for each set of parameters, according to the set of values determined during physical access in the control space and the class corresponding to the type of fraud for this set of parameters; and determining a global probability of fraud associated with the physical access in the control space according to the probabilities of fraud obtained for each set of parameters and for each type of fraud, and protecting physical access to the sensitive area based on the global probablity of fraud.

* * * * *

UNITED STATES PATENT AND TRADEMARK OFFICE

CERTIFICATE OF CORRECTION

PATENT NO. : 7,847,688 B2
APPLICATION NO. : 12/086526
DATED : December 7, 2010
INVENTOR(S) : Emmanuel Bernard It is certified that error appears in the above-identified patent and that said Letters Patent is hereby corrected as shown below:

On the title page

In Item (56) References Cited

U.S. PATENT DOCUMENTS:, replace "2006/0136746 A1* 6/2006 Al-Khateeb.....713/189" with --2006/0136743 A1* 6/2006 Polcha et al.....713/186--

Signed and Sealed this
Seventh Day of June, 2011

David J. Kappos

David J. Kappos
*Director of the United States Patent and Trademark Office*